US008226383B2

(12) United States Patent
Henry et al.

(10) Patent No.: US 8,226,383 B2
(45) Date of Patent: Jul. 24, 2012

(54) DOWNHOLE PUMP

(76) Inventors: James Henry, Midland, TX (US); David Henry, Lubbock, TX (US); Milt Skillman, Mount Vernon, TX (US)

( * ) Notice: Subject to any disclaimer, the term of this patent is extended or adjusted under 35 U.S.C. 154(b) by 1350 days.

(21) Appl. No.: 11/851,687

(22) Filed: Sep. 7, 2007

(65) Prior Publication Data

US 2009/0068026 A1 Mar. 12, 2009

(51) Int. Cl.
*F04B 17/00* (2006.01)

(52) U.S. Cl. ..... 417/422; 166/329

(58) Field of Classification Search ..... 417/422; 166/329; 92/33; 277/322, 336
See application file for complete search history.

(56) References Cited

U.S. PATENT DOCUMENTS

| | | | | | |
|---|---|---|---|---|---|
| 3,397,643 | A | * | 8/1968 | Jepsen | 417/415 |
| 4,417,860 | A | * | 11/1983 | Justice | 417/415 |
| 5,297,805 | A | * | 3/1994 | Merkin et al. | 277/322 |
| 5,992,517 | A | * | 11/1999 | McAnally | 166/105 |
| 6,086,339 | A | * | 7/2000 | Jeffrey | 417/415 |
| 6,155,792 | A | * | 12/2000 | Hartley et al. | 417/53 |

* cited by examiner

*Primary Examiner* — Charles Freay
*Assistant Examiner* — Patrick Hamo
(74) *Attorney, Agent, or Firm* — James Harlan

(57) ABSTRACT

An apparatus for pumping fluids from a geologic formation comprising a submersible motor having a motor shaft, wherein said submersible motor is reversible and has a plurality of speed settings; a pump housing connected to said submersible motor by a motor mount, wherein said pump housing has a lubricant contained therein; and a tube connected to said pump housing having a pump barrel disposed therein, wherein said pump barrel has an upper barrel connector that is connected to a standing valve; whereby a reciprocating motion by a ball nut applies said lubricant on a ball screw, and associated method of use.

12 Claims, 5 Drawing Sheets

DOWNHOLE PUMP

TECHNICAL FIELD

The presently preferred embodiment relates generally to pumping. More specifically, the presently preferred embodiment relates to a downhole pumping apparatus to remove fluid from a formation.

BACKGROUND

A patentability investigation was conducted and the following U.S. Patents were discovered: U.S. Pat. No. 6,155,792 to Hartley ("Hartley"), U.S. Pat. No. 6,086,339 to Jeffrey ("Jeffrey"), U.S. Pat. No. 5,992,517 to McAnally ("McAnally"), U.S. Pat. No. 4,417,860 to Justice ("Justice"), and U.S. Pat. No. 3,397,643 to Jespen ("Jespen").

Hartley teaches an apparatus for pumping fluids comprising a tubular housing; a pump assembly in the tubular housing; a rotating assembly in the tubular housing; a gear assembly coupled to the rotating rod assembly; and a motor assembly coupled to the tubular housing and the gear assembly. The tubular housing has at least one intake port for the inflow of fluids from the annulus. The pump assembly has a generally hollow reciprocating pump plunger with apertures. The rotating rod assembly has a rotating rod assembly and surrounds the reciprocating pump plunger. The rotating rod has a number of apertures for the inflow of fluids. Hartley also discloses the use of helical tracks with ball bearings. Additionally, Hartley discloses the use of an electric motor installed with a pressure sensor that allows the well to be placed on automatic and be pumped within certain fluid level parameters.

Jeffrey describes a pumping housing having an inlet and an outlet, a plunger reciprocally disposed in the pumping housing, a prime mover having a rotating output shaft, and a transmission connected to the plunger and the prime mover. The transmission is adapted to convert rotating motion of the output shaft of the prime mover into reciprocating motion of the plunger.

McAnally discloses a downhole reciprocating plunger pump that includes multiple cylinders with a crankshaft supported on a frame for rotation about an axis. As the crankshaft rotates about an axis, fluid flows into various chambers for discharge into an accumulator space up through a conduit to a storage tank.

Justice teaches a displacement pump with a motor, a small diameter transmission mechanism having axially aligned input and output shafts; and a pump mechanism mounted thereon. The pump has a cylinder with inlet and outlet ports, and a cam shaft connected to and driven by the output shaft of the transmission mechanism. The pump also has a piston working in the cylinder, driven by the cam shaft.

Jepsen teaches drawing well fluid into a charging chamber while simultaneously discharging a like quantity of well fluid from a pumping chamber into the well tubing during the up-stroke of the pump, then transferring the well fluid from the charging chamber to the pumping chamber against the back pressure of the well fluid in the well tubing during the down-stroke of the pump.

The foregoing prior art pumping systems, as well as other prior art, are hindered with a high cost and frequency of well servicing. Such prior art pumping system posses a lot of mechanical wear and tear, especially with the ball screw and ball screw nut.

Therefore, what is needed is a downhole pumping apparatus that does not posses the deficiencies associated with the prior art pumping systems, and one which greatly extends the useful life of the ball screw and ball screw nut.

SUMMARY

To achieve the foregoing, and in accordance with the purpose of the presently preferred embodiment as broadly described herein, the present application provides an apparatus for pumping fluids from a geologic formation comprising a submersible motor having a motor shaft, wherein said submersible motor is reversible and has a plurality of speed settings; a pump housing connected to said submersible motor by a motor mount, wherein said pump housing has a lubricant contained therein; and a tube connected to said pump housing having a pump barrel disposed therein, wherein said pump barrel has an upper barrel connector that is connected to a standing valve; whereby a reciprocating motion by a ball nut applies said lubricant on a ball screw. The apparatus, wherein said pump housing further comprises a thrust bearing housing disposed between said motor mount and a ball screw sleeve. The apparatus, wherein said thrust bearing housing has at least one thrust bearing. The apparatus, wherein said pump housing further comprises a rotating shaft coupled to said motor shaft. The apparatus, where said pump housing further comprises a ball screw shaft connected to said rotating shaft and disposed in said ball screw sleeve. The apparatus, wherein said ball screw shaft is threadingly engaged with a ball screw nut that moves in a linear manner along a guide track. The apparatus, wherein said pump housing further comprises a ball screw encapsulator connected to said ball screw nut, wherein said ball screw encapsulator has an outer diameter with a smooth surface finish. The apparatus, wherein said ball screw encapsulator has an intake connector disposed thereon. The apparatus, wherein said pump housing further comprises a seal cartridge housing connected between said ball screw sleeve and a plunger sleeve. The apparatus, wherein said seal cartridge housing has a gas seal and a liquid seal. The apparatus, where said pump housing further comprises a sleeve-barrel-tubing connector having a first end connected to said plunger sleeve and a connector end, wherein said sleeve-barrel-tubing connector has a plurality of intake ports. The apparatus, where said pump housing further comprises a pump plunger having an intake connector end with a plurality of orifices. The apparatus, wherein said pump plunger has a traveling valve connector end that is connected to a traveling valve. The apparatus, wherein said pump plunger has an outer diameter to form a sliding seal with an inside diameter of a pump barrel.

Another advantage of the presently preferred embodiment is to provide pumping apparatus, said apparatus comprising a lubricant carried along a ball screw by a ball screw nut; and a seal system, wherein at least one seal prevents formation fluid from passing into an environment comprised of at least a lubricant and a gas. The pumping apparatus, whereby a reciprocating motion by a submersible motor applies said lubricant on a ball screw. The pumping apparatus, wherein said reciprocating motion is affected by a submersible motor, wherein said submersible motor is reversible and has a plurality of speed settings. The pumping apparatus, wherein said submersible motor has a motor control that allows for one of a soft start and a soft reverse. The pumping apparatus, wherein said seal system is a dual seal system, wherein a first seal disposed towards said ball screw nut prevents gas from passing into a liquid, and a second seal disposed above said first seal to prevent liquid from passing into an environment comprised of at least said lubricant and said gas.

Still another advantage of the presently preferred embodiment is to provide a method of pumping formation fluid from a well, comprising the steps of locating a downhole pump in a well of a geologic formation having a formation fluid, wherein said well has a lower pressure than said geologic formation so that said formation fluid flows into said well; reciprocating a pump plunger within said downhole pump so that said well is one of a pumped-off and a low formation fluid level; lubricating a ball screw and a ball nut with a lubricant during said reciprocating step; and sealing said lubricant from said formation fluid during said reciprocating step.

Other advantages of the presently preferred embodiment will be set forth in part in the description and in the drawings that follow, and, in part will be learned by practice of the invention.

The presently preferred embodiment will now be described with reference made to the following Figures that form a part hereof. It is understood that other embodiments may be utilized and changes may be made without departing from the scope of the present invention.

BRIEF DESCRIPTION OF THE DRAWINGS

A presently preferred embodiment will hereinafter be described in conjunction with the appended drawings, wherein like designations denote like elements, and.

DETAILED DESCRIPTION OF THE PREFERRED EMBODIMENTS

The numerous innovative teachings of the present application will be described with particular reference to the presently preferred embodiments. It should be understood, however, that this class of embodiments provides only a few examples of the many advantageous uses of the innovative teachings herein. The presently preferred embodiment provides, among other things, an apparatus, system and method of downhole pumping.

Structure

Figure 1:
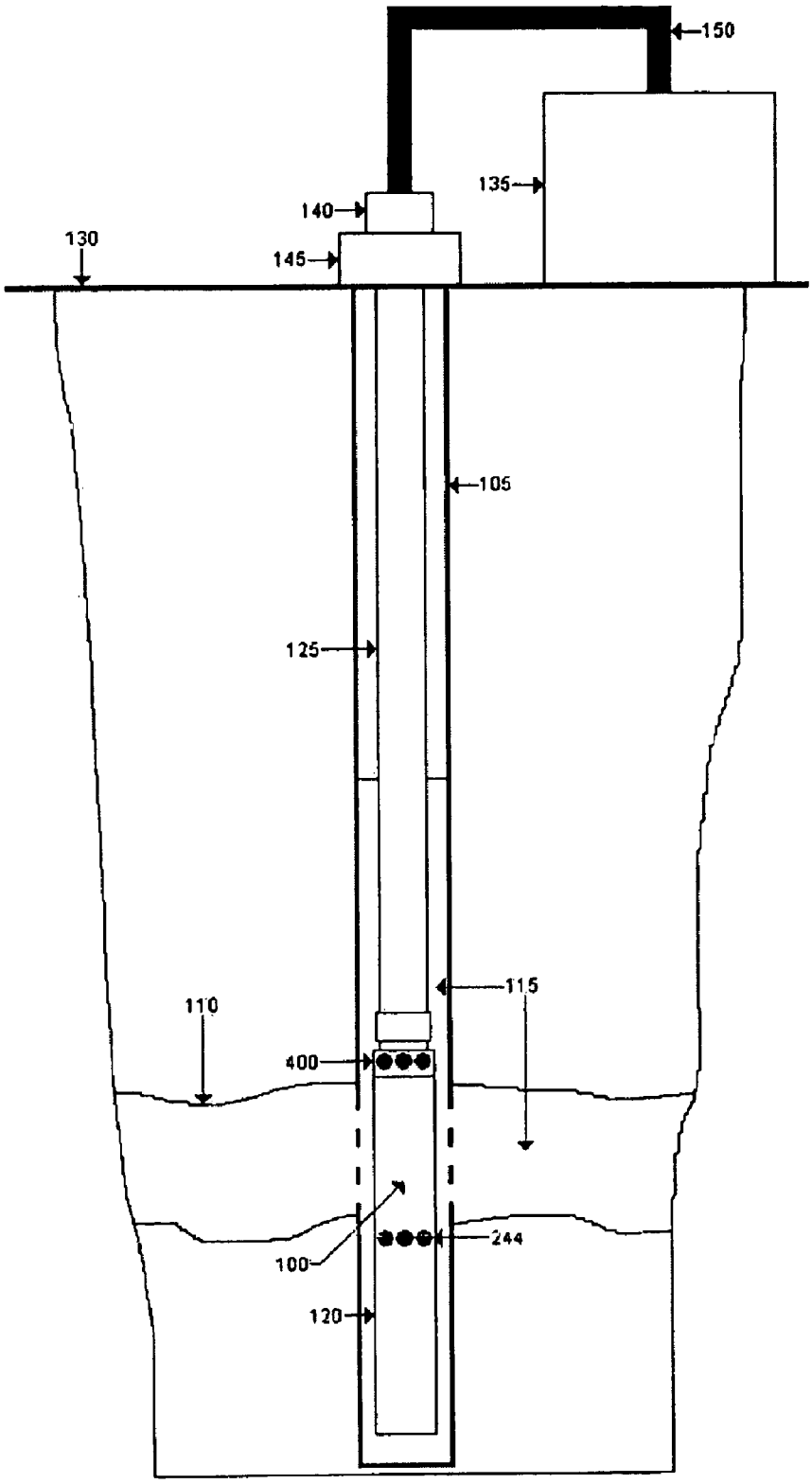
FIG. 1 is a partial cross-section of the presently preferred embodiment in an operating position in a well.

In discussing the structure of the presently preferred embodiment, it is important to understand the context, particularly in downhole pumping. That being said, FIG. 1 is a view of the presently preferred embodiment in an operating position in a well. As shown in FIG. 1, there is shown a downhole pump, generally illustrated at 100, that is situated in a well 105 created in a geologic formation 110 for the extraction of a formation fluid 115. The formation fluid 115 is a liquid that can be water or petroleum, for example. The downhole pump 100 includes a pump-motor housing 120, a tubing 125, and a motor control (not depicted) that is commonly located at a surface 130. The tubing 125 is a fluid conduit for the formation fluid 115 to flow from the geologic formation 110 to the surface 130 for storage in a tank 135. It is understood that the surface 130 is used in a generic sense, and in fact the formation fluid 115 is moved to a location that is distinct from the geologic formation 110. Likewise, it is understood that the formation fluid 115 does not have to be moved for storage, but can be moved for direct application, e.g., refining processing.

Figure 2:
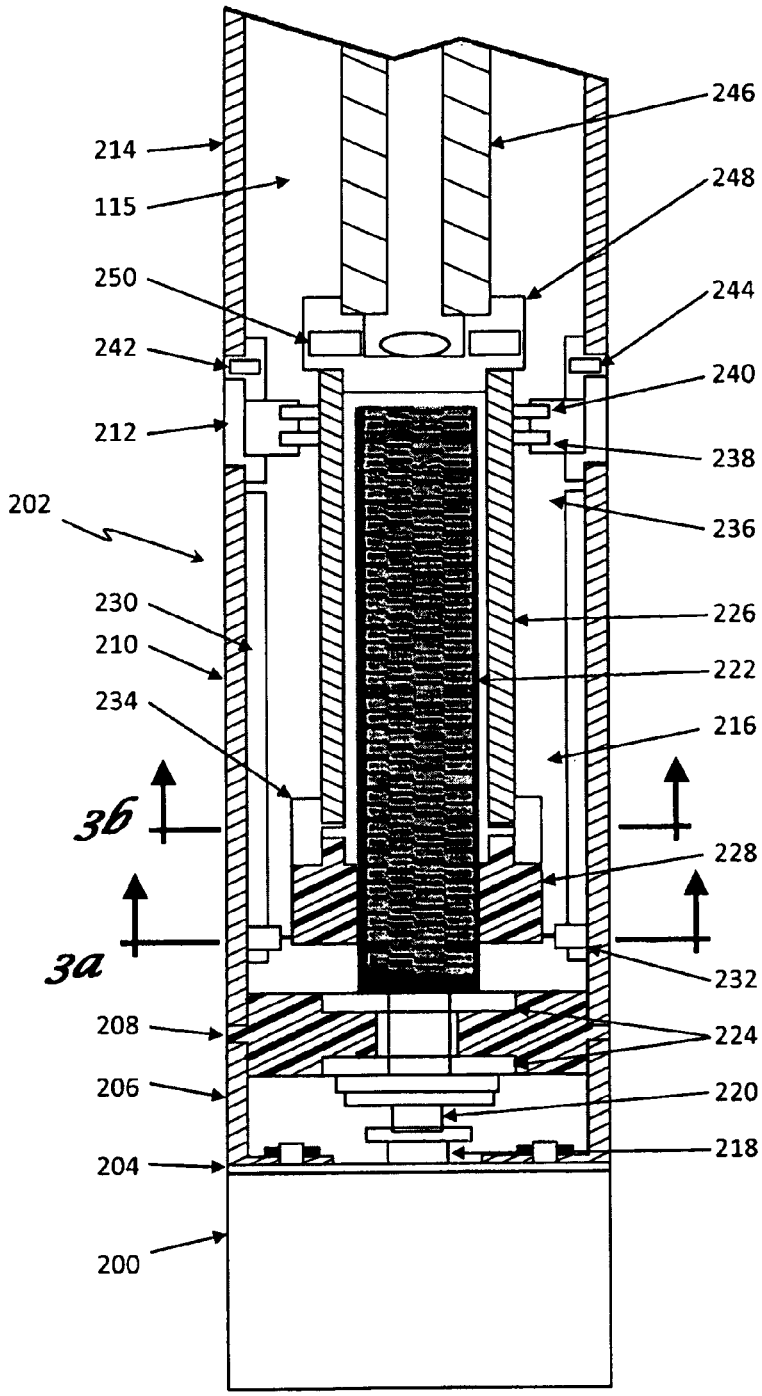
FIG. 2 is an illustration of a partial cross section of a pump-motor housing.

FIG. 2 is a partial cross-section of the pump-motor housing 120. Referring to FIG. 2, the pump-motor housing 120 has a submersible motor 200 and a pump housing 202. The submersible motor 200 is variable speed and reversible. Also the submersible motor 200 is powered by an electric cable (not depicted) extended from the surface 130. The submersible motor 200 is connected to the pump housing 202 by known means such as nut/bolt combination, or other such combination that allows secure attachment with the ability to remove the submersible motor 200. The pump housing 202 consists of a motor mount 206, a thrust bearing housing 208, a ball-screw sleeve 210, a seal cartridge housing 212 and a plunger sleeve 214. Within the motor mount 206, the thrust bearing housing 208 and the ball-screw sleeve 210 is a lubricant 216 that aids in reducing friction and wear. Beginning with the motor mount 206 that contains a motor shaft 218 extending from the submersible motor 200 and is coupled to a rotating shaft 220 that translates rotating power from the submersible motor 200 to a ball screw 222. Connected to the motor mount 206 by a threaded means is the thrust bearing housing 208 that has two thrust bearings 224 and keeps the thrust bearings 224 square with the rotating shaft 220. The thrust bearing housing 208 is commonly understood in the industry and will not be discussed further. The ball-screw sleeve 210 is connected to the thrust bearing housing 208 by a threaded means. Contained within the ball-screw sleeve 210 is a ball screw encapsulator 226, a ball nut 228, and a guide bearing track 230. On the ball nut 228 are two guide bearings 232.

Figure 3A:
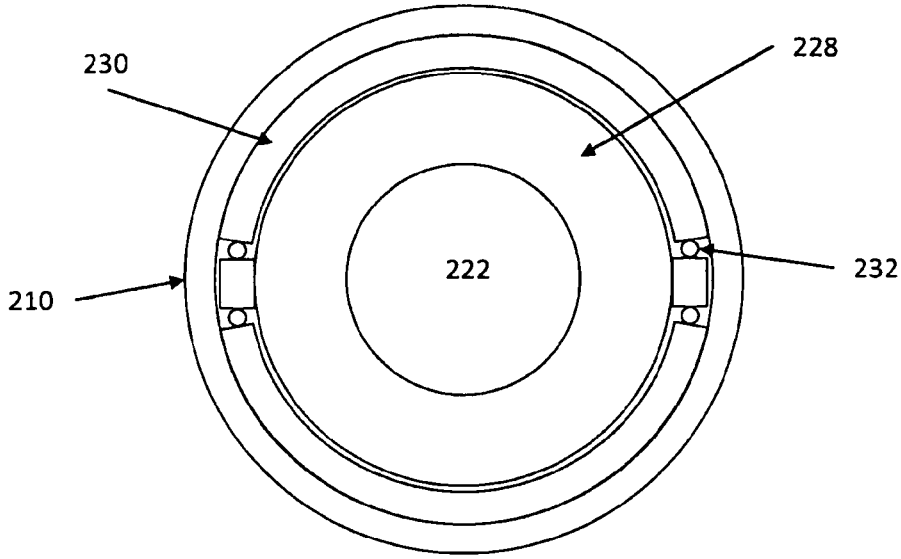
FIG. 3 is a cross-sectional views of two locations within a ball screw sleeve.
Figure 3B:
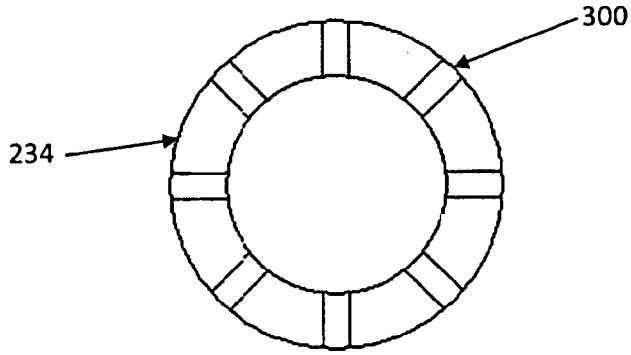

FIG. 3 is a cross-sectional views of two locations within a ball screw sleeve, where FIG. 3*a* is a cross-sectional view illustrating the guide bearings 232 and the guide bearing track 230, and where FIG. 3*b* is a cross-sectional view of the ball-nut-to-encapsulator coupling 234. Referring to FIG. 3*a*, the two guide bearings 232 are situated opposite one another to prevent the ball nut 228 from rotating with the ball screw 222 during operation. Of course it is understood that the goal of the two guide bearings 232 is to stop the rotating motion of the ball nut 228 while allowing the linear motion up and down the ball screw 222, so other methods of prohibiting said rotation while allowing linear movement are anticipated. Connecting the ball nut 228 to the ball screw encapsulator 226 is a ball-nut-to-encapsulator coupling 234. Referring to FIG. 3*b*, the ball-nut-to-encapsulator coupling 234 has a plurality of through holes 300 to allow the lubricant 216 to flow into the ball screw encapsulator 226, the purpose of which was previously discussed.

Continuing with FIG. 2, the ball screw sleeve 210 is threadingly connected with the seal cartridge housing 212, which has a dual seal system that separates an air side 236 from the formation fluid 115. An air seal 238 faces the direction of the submersible motor 200 and is designed to hold air in the air side 236 and prevent the air from leaking into the formation fluid 115. Coaxial to the air seal 238 in the dual seal system is a fluid seal 240 that faces toward the plunger sleeve 214 and is designed to prevent the formation fluid 115 from leaking down into the air side 236. It is important to note that an outer diameter of the ball screw encapsulator 226 has a smooth surface finish, as opposed to a rough finish, to allow proper sealing with the air seal 238 and the fluid seal 240, without undue wear to the dual seal system during pumping operation.

Further to FIG. 2, disposed between the seal cartridge housing 212 and the plunger sleeve 214 is a housing sleeve connector 242 with a plurality of ported holes 244. The ported holes 244 provide an orifice for the formation fluid 115 to flow into the plunger sleeve 214. The plunger sleeve 214 has a pump plunger 246 coaxially disposed therein, the pump plunger 246 is threadingly connected to the ball screw encapsulator 226 by an encapsulator-to-plunger intake connector 248. The encapsulator-to-plunger intake connector 248 has a plurality of radial openings 250 to allow the formation fluid 115 to flow into the pump plunger 246, the operation of which will be discussed below.

Figure 4:
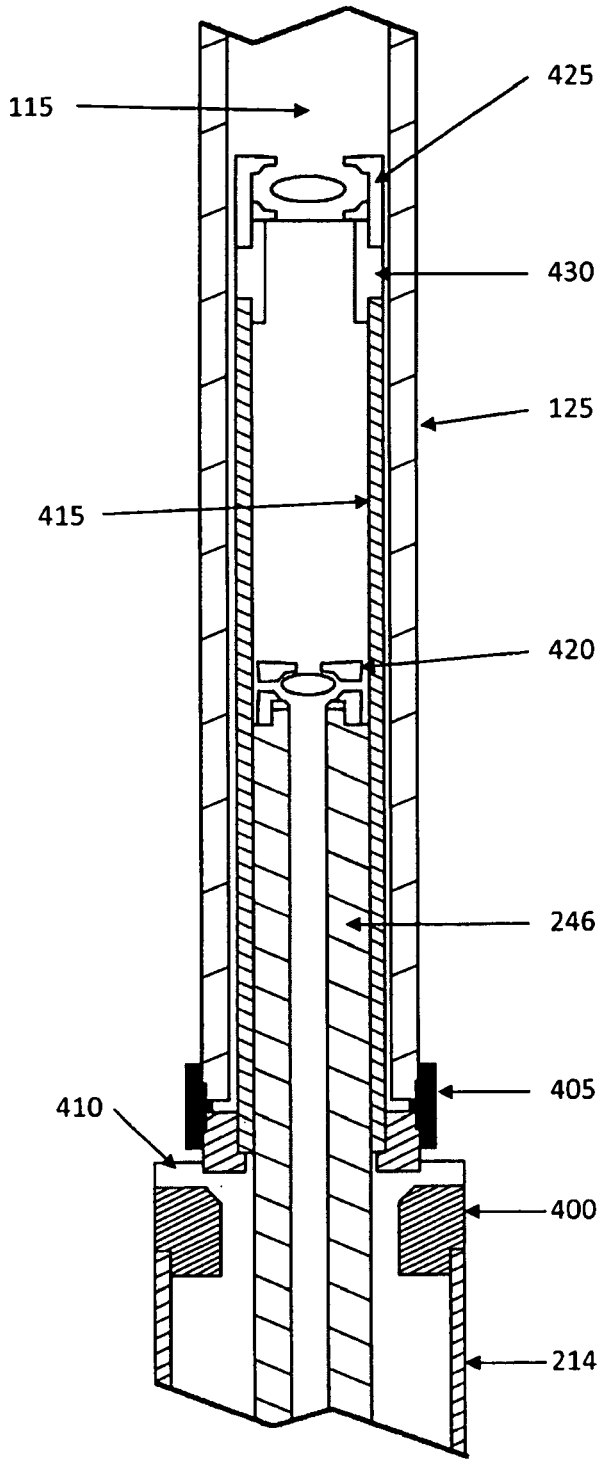
FIG. 4 is a partial cross-section of a pump-motor housing connected to a tubing.
Figure 5A:
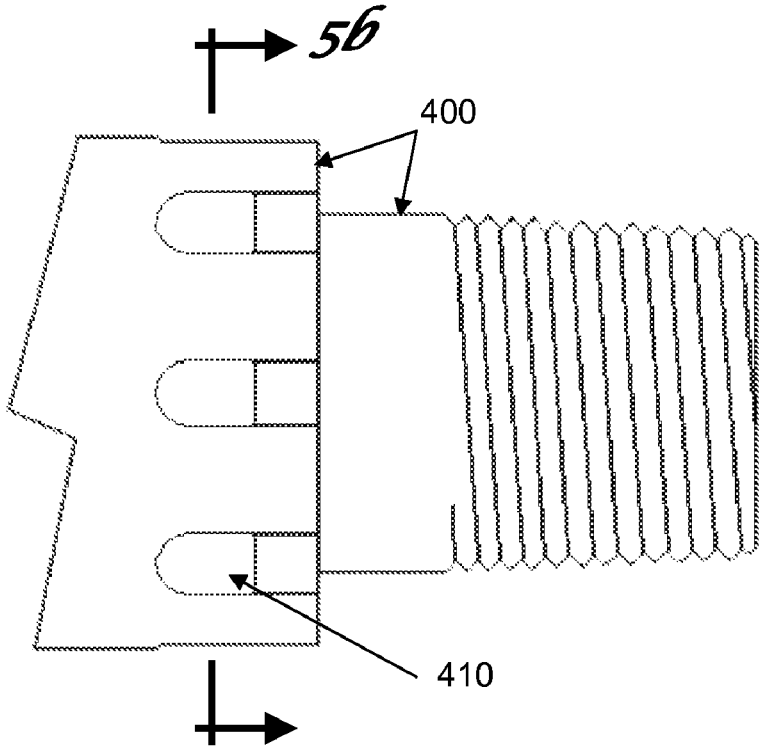
FIG. 5 is a view of a sleeve-barrel-tubing connector.
Figure 5B:
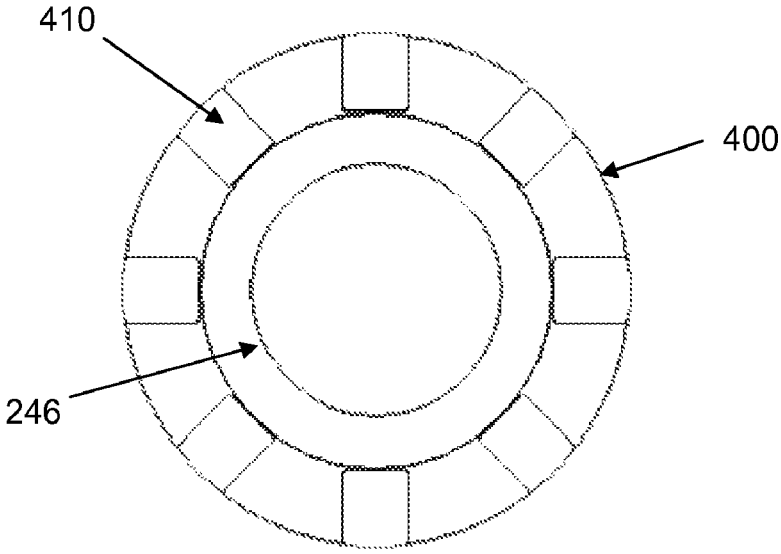

FIG. 4 is a partial cross-section of a pump-motor housing connected to a tube. As shown in FIG. 4, the plunger sleeve 214 is connected to the tubing 125 by a sleeve-barrel-tubing coupling 400 and a tubing connector 405. The sleeve-barrel-tubing coupling 400 has a plurality of flow through slots 410 to allow formation fluid 115 to flow from the annulus into the plunger sleeve 214, as illustrated in more detail in FIG. 5*a* and FIG. 5*b*. Connected to the sleeve-barrel-tubing coupling 400 is a pump barrel 415 that is also displaced within the tubing 125. The interior of the pump plunger 246 is hollow for formation fluid 115 and the exterior of the pump plunger 246 creates a sliding seal with the inside diameter of the pump barrel 415. Within the pump barrel 415 and on the opposite end from the encapsulator to plunger intake connector 248 is a traveling valve 420. Connected at an opposite end of the pump barrel 415 is a standing valve 425 and an upper barrel connector 430 disposed therebetween. The traveling valve 420 is referred to as "traveling" because it moves with or is attached to the reciprocating method of the pump plunger 246. This is typically done with sucker rods that are above the typical downhole pump 100. Also in a typical downhole pump 100, the traveling valve is the valve between the pump chamber (inside the pump barrel) and the tubing 125. The standing valve is called "standing" because it is stationary with no movement caused by the reciprocating method of the pump plunger 246. Typically the standing valve is the intake valve that acts between the formation fluid 115 in the well bore and the pump barrel 415. In the presently preferred embodiment, the traveling valve 420 is the intake valve for the pump 100. Formation fluid 115 is introduced to the pump barrel 415 through the traveling valve 420. The pump plunger 246 is reciprocated from below. And the standing valve 425 allows fluid from the pump barrel 415 to enter the tubing 125. The upper end of the tubing 125 extends through a wellhead assembly 140 suitable mounted on a surface casing 145 and suitably connected to a discharge conduit 150.

Operation

Placed in the well 105, the downhole pump 100 has flow-through slots 410 and 242 for the formation fluid 115 to transfer from the annulus to the interior of the plunger sleeve 214. The transfer occurs by basic concepts of fluid flow from a higher pressure location to a lower pressure location. In operation, the downhole pump 100 in the well 105 is activated by the submersible motor 200 that rotates the motor shaft 218 in a clockwise direction so as to rotate the ball screw 222 in a clockwise direction causing the ball nut 228 to travel up. Likewise, the submersible motor 200 rotates the motor shaft 218 in a counter-clockwise direction so as to rotate the ball screw 222 in a counter-clockwise direction causing the ball nut 228 to travel down. The up and down linear stroke motion, e.g., an up-stroke and a down-stroke, of the ball nut 228 causes the pump plunger 246 to reciprocate. As the ball nut 228 travels to its downward position, it picks-up the lubricant 216 to carry it up the ball screw 222 on the up-stroke. The lubricant 216 is free to flow into the ball nut 228 and up the ball screw 222 because of the through holes 300 provided in the ball-nut-to-encapsulator coupling 234. A lower portion of the ball screw 222 remains submerged in the lubricant 216 regardless of the position of the ball nut 228.

As the pump plunger 246 strokes downward, the standing valve 425 is closed. The low pressure area of the pump barrel 415 opens the traveling valve 420. The formation fluid 115 that has entered the plunger sleeve 214 that flows through the encapsulator-to-plunger intake connector 248 into interior of the pump plunger 246 through the radial openings 250. The formation fluid 115 then flows through the traveling valve 420 into the pump barrel 415, filling it as the interior volume of the pump barrel 415 increases from the pump plunger 246 stroking down.

As the pump plunger 246 strokes upward, the traveling valve 420 shuts the inner diameter of the pump plunger 246, which allows the pump plunger 246 to push the formation fluid 115 in the pump barrel 415 upward. When the pressure in the pump barrel 415 is greater than the hydrostatic pressure of the tubing 125 the standing valve 425 opens. As the pump plunger 246 rises the formation fluid 115 in the pump barrel 415 is added to the tubing 125. The reciprocating up-stroke and down-stroke action is repeated over and over filing the tubing 125 and then the tank 135 on the surface 130.

The presently preferred embodiment may advantageously have the motor control on the surface 130 to allow easy changes by an operator. Hard or fast stops and starts of rotating or reciprocating parts can torque and stress the parts or the assembly disclosed herein. This torque can twist, compress or stretch the moving parts or pump assembly. Also threaded assemblies can loosen or unscrew and hard opening and closing of valves can cause premature failure. The motor control is programmable and changeable so the rotation speed or RPM of the motor shaft 218 can be slowed, sped up, paused, stopped, started or reversed at any point. It also lets the operator know the position and direction the ball nut 228. This therefore tells you the position and direction of movement of the pump plunger 246 inside the pump barrel 415. Having this ability we see as an advantage as it allows the operator to do a "soft start" and a "soft reverse". The rotation of the ball screw 222 can be slowly started if the motor and pump are stopped for any reason. Once the mass is moving it can be sped up without undue stress to the moving parts. This is called a "soft start".

As the pump plunger 246 reaches the end of its upward stroke it can be slowed down and then stopped. A pause of any length of time can be added to ensure the gentle closing of the standing valve. At this time the submersible motor 200 can be reversed and restarted slowly, gently opening the traveling valve as the pump plunger 246 starts it downward movement. Once the mass is moving it can be sped up. As the pump plunger 246 gets close to the end if its down stroke it can be slowed down and stopped gently closing the traveling valve 420. The submersible motor 200 will be reversed, then slowly started, then sped up once moving. This is called a "soft reverse". Another use of the control is the ability to change the stroke length or the length the ball nut 228 travels on the ball screw 222 before reversing.

The presently preferred embodiment may advantageously have the motor control with the ability to monitor the AMP draw or the loads the submersible motor 200 is sensing. As the formation fluid 115 flows to the well 105, the well 105 must have a lower pressure than the geologic formation 110 for this to happen. The formation fluid 115 in the well 105 will rise or fill the well 105 until the pressure in the well 105 is equal to the pressure in the geologic formation 110. At this point formation fluid 115 must be removed or pumped from the well 105 for more formation fluid 115 to enter the well 105. The desire of the operator is to keep the well 105 pumped off or at a low fluid level so the formation fluid 115 can move freely to the well 105 so the well 105 can be produced at its maximum level. If the downhole pump 100 removes formation fluid 115 from the well 105 at a rate faster than the geologic formation 110 can replenish it, the well is in a pumped off condition. In a pumped off condition the there is not enough fluid to completely fill the pump barrel 415 with fluid. When the pump barrel 415 is full the standing valve 425 opens as soon as the pump plunger 246 starts its upward travel. The pump plunger 246 sees a full load as it lifts the column of fluid on top of it. The motor control monitors the load on the submersible motor 200 and can see the greater load as soon as the up stroke is started. By monitoring the load on the submersible motor 200 one is able to tell how the pump barrel 415 is filling. If the pump barrel 415 does not completely fill, the control will show that the motor is not under load as it starts the up stroke. Depending on where during the up stroke the motor load increases, it indicates the percentage of the pump barrel 415 filled with fluid. Operating the downhole pump 100 without complete filling of the pump barrel 415 is over pumping the well 105. It is a waste of energy when there is movement of the pump assembly but no fluid being pumped. When this pumped off condition occurs the motor control will allow the operator different options. One option is to reduce the cycles or strokes per minute. Buy slowing down the downhole pump 100 the operator can match the pump production rate to the inflow of the formation fluid 115 into the well 105, creating an efficient pumping system. Another option when the well is pumped off is to shut down the pump for a predetermined amount of time. With the timing capability of the motor control the downhole pump 100 can be turned off so the formation fluid 115 can build back up in the well 105. After a set amount of time the downhole pump 100 will turn back on and produce the new fluid which has filled the well 105.

A number of embodiments have been described. It will be understood that various modifications may be made without departing from the spirit and scope of the presently preferred embodiment. Therefore, other implementations are within the scope of the following claims.

What is claimed is:

1. An apparatus for pumping fluids from a geologic formation comprising:

a submersible motor having a motor shaft, wherein said submersible motor is reversible and has a plurality of speed settings;

a pump housing connected to said submersible motor by a motor mount, wherein said pump housing has a lubricant contained therein, comprising:

a seal cartridge housing connected between a ball screw sleeve and a plunger sleeve; and a sleeve-barrel-tubing connector having a first end connected to said plunger sleeve and a connector end, wherein said sleeve-barrel-tubing connector has a plurality of intake ports; and a tube connected to said pump housing having a pump barrel disposed therein, wherein said pump barrel has an upper barrel connector that is connected to a standing valve.

2. The apparatus of claim 1, wherein said pump housing further comprises a thrust bearing housing disposed between said motor mount and said ball screw sleeve.

3. The apparatus of claim 2, wherein said thrust bearing housing has at least one thrust bearing.

4. The apparatus of claim 1, wherein said pump housing further comprises a rotating shaft coupled to said motor shaft.

5. The apparatus of claim 1, where said pump housing further comprises a ball screw connected to said rotating shaft and disposed in said ball screw sleeve.

6. The apparatus of claim 5, wherein said ball screw is threadingly engaged with a ball screw nut that moves in a linear manner along a guide track.

7. The apparatus of claim 1, wherein said pump housing further comprises a ball screw encapsulator connected to said ball screw nut, wherein said ball screw encapsulator has an outer diameter with a surface finish.

8. The apparatus of claim 7, wherein said ball screw encapsulator has an intake connector disposed thereon.

9. The apparatus of claim 1, wherein said seal cartridge housing has a gas seal and a liquid seal.

10. The apparatus of claim 1, where said pump housing further comprises a pump plunger having an intake connector end with a plurality of orifices.

11. The apparatus of claim 10, wherein said pump plunger has a traveling valve connector end that is connected to a traveling valve.

12. The apparatus of claim 10, wherein said pump plunger has an outer diameter to form a sliding seal with an inside diameter of a pump barrel.

* * * * *